US010640838B2

(12) United States Patent
Schwinghammer et al.

(10) Patent No.: US 10,640,838 B2
(45) Date of Patent: May 5, 2020

(54) METHOD FOR PRODUCING HARDENED COMPONENTS WITH REGIONS OF DIFFERENT HARDNESS AND/OR DUCTILITY

(75) Inventors: Harald Schwinghammer, Pasching (AT); Andreas Sommer, Crailsheim (DE); Siegfried Kolnberger, Pasching (AT); Martin Rosner, Oed-Öhling (AT); Thomas Kurz, Linz (AT)

(73) Assignee: voestalpine Stahl GmbH, Linz (AT)

( * ) Notice: Subject to any disclaimer, the term of this patent is extended or adjusted under 35 U.S.C. 154(b) by 1013 days.

(21) Appl. No.: 13/997,416

(22) PCT Filed: Dec. 22, 2011

(86) PCT No.: PCT/EP2011/073889
§ 371 (c)(1),
(2), (4) Date: Oct. 15, 2013

(87) PCT Pub. No.: WO2012/085253
PCT Pub. Date: Jun. 28, 2012

(65) Prior Publication Data

US 2014/0027026 A1 Jan. 30, 2014

(30) Foreign Application Priority Data

Dec. 24, 2010 (DE) ..... 10 2010 056 264
Dec. 24, 2010 (DE) ..... 10 2010 056 265
(Continued)

(51) Int. Cl.
*C21D 8/00* (2006.01)
*C21D 9/48* (2006.01)
(Continued)

(52) U.S. Cl.
CPC ..... *C21D 8/005* (2013.01); *C21D 1/673* (2013.01); *C21D 9/48* (2013.01); *C23C 2/02* (2013.01); *C23C 2/28* (2013.01)

(58) Field of Classification Search
CPC ..... C21D 1/673; C21D 9/48; C21D 8/005; C23C 2/02; C23C 2/28
See application file for complete search history.

(56) References Cited

U.S. PATENT DOCUMENTS 8,597,441 B2 * 12/2013 Sommer ..... C21D 1/673 148/640
2011/0132052 A1 * 6/2011 Faderl ..... C23C 2/02 72/47
(Continued)

FOREIGN PATENT DOCUMENTS

DE 102005003551 A1 7/2006
EP 1651789 B1 5/2006
(Continued)

OTHER PUBLICATIONS

Dosdat, L. et al., "Corrosion resistance of different metallic coatings on press-hardened steels for Automotive," Apr. 2011, 8 pages, ArcelorMittal Maizieres, Research and Development Automotive Products, Maisieres-les-Metz, France.
(Continued)

*Primary Examiner* — Colleen P Dunn
*Assistant Examiner* — Michael J Kachmarik

(57) ABSTRACT

The invention relates to a method for producing a hardened, steel component with regions of different hardness and/or ductility; a blank is stamped out and either heated in some regions to a temperature $\geq Ac_3$, and then transferred to a forming die, is formed, and is cooled at a speed that is greater than the critical hardening speed and thus hardened or is cold formed into the finished shape and the formed blank is heated in some regions to a temperature $>Ac_3$ and
(Continued)

The time/temperature curve of the cooling in the transfer from furnace to forming then transferred to a hardening die and is hardened at a speed greater than the critical hardening speed; the steel material is adjusted in a transformation-delaying fashion so that a quench hardening through transformation of austenite into martensite takes place at a forming temperature that lies in the range from 450° C. to 700° C.; after the heating and before the forming, an active cooling takes place at >15 K/s.

8 Claims, 8 Drawing Sheets

(30) Foreign Application Priority Data

Sep. 26, 2011 (DE) ..... 10 2011 053 939
Sep. 26, 2011 (DE) ..... 10 2011 053 941

(51) Int. Cl.
*C21D 1/673* (2006.01)
*C23C 2/02* (2006.01)
*C23C 2/28* (2006.01)

(56) References Cited

U.S. PATENT DOCUMENTS

| | | | | |
|---|---|---|---|---|
| 2012/0097298 | A1* | 4/2012 | Sommer | C21D 1/673 148/640 |
| 2012/0291510 | A1* | 11/2012 | Kim | B21D 22/02 72/342.6 |
| 2013/0025340 | A1* | 1/2013 | Kobayashi | B21D 22/02 72/332 |

FOREIGN PATENT DOCUMENTS

| | | | | | |
|---|---|---|---|---|---|
| EP | 1642991 | B1 | | 2/2009 | |
| EP | 1439240 | B1 | | 5/2010 | |
| EP | 1651789 | B1 | | 8/2010 | |
| JP | 2005177805 | | | 7/2005 | |
| JP | 2005177805 | A | | 7/2005 | |
| JP | 2007016296 | | | 1/2007 | |
| JP | 2007016296 | A | | 1/2007 | |
| JP | 2007182608 | | | 7/2007 | |
| JP | 2007182608 | A | * | 7/2007 | |
| JP | 2007182608 | A | * | 7/2007 | |
| JP | 2007275937 | A | | 10/2007 | |
| JP | 2009061473 | A | | 3/2009 | |
| JP | 2009095869 | A | | 5/2009 | |
| JP | 2010180428 | A | | 8/2010 | |
| SU | 330202 | | * | 4/1972 | |
| WO | 2010089644 | | | 8/2010 | |
| WO | 2010089644 | A1 | | 8/2010 | |
| WO | 2010109012 | | | 9/2010 | |
| WO | 2010109012 | A1 | | 9/2010 | |
| WO | WO-2010109012 | A1 | * | 9/2010 | C21D 1/673 |
| WO | WO 2010109012 | A1 | * | 9/2010 | C21D 1/673 |

OTHER PUBLICATIONS

Drillet, Pascal, et al., "Study of Cracks Propagation Inside the Steel on Press Hardened Steel Zinc Based Coatings," 2011, 8 pages, ArcelorMittal Maizieres, Research and Development Automotive Products, Maisieres-les-Metz, France.

* cited by examiner

The time/temperature curve of the cooling in the transfer from furnace to forming Sheet undergoes intermediate cooling to a uniform temperature

Process is significantly more robust:
less warping in the die, smaller ΔT between the die and sheet, less shrinkage during hardening, etc...

METHOD FOR PRODUCING HARDENED COMPONENTS WITH REGIONS OF DIFFERENT HARDNESS AND/OR DUCTILITY

FIELD OF THE INVENTION

The invention relates to a method for producing hardened components with regions of different hardness and/or ductility.

BACKGROUND OF THE INVENTION

It is known that particularly in automobiles, so-called press-hardened components composed of sheet steel are used. These press-hardened components composed of sheet steel are high-strength components that are particularly used as safety components in the region of the vehicle body. In this connection, the use of these high-strength steel components makes it possible to reduce the material thickness relative to a normal-strength steel and thus to achieve low vehicle body weights.

In press-hardening, there are basically two different possibilities for manufacturing such components. They are divided into the so-called direct and indirect methods.

In the direct method, a sheet steel blank is heated to a temperature greater than the so-called austenitization temperature and if need be, kept at this temperature until a desired degree of austenitization is achieved. Then, this heated blank is transferred to a forming die and in this forming die, is shaped into the finished component in a one-step forming process and in so doing, by means of the cooled forming die, simultaneously cooled at a speed that is greater than the critical hardening speed. This produces the hardened component.

In the indirect method, first, possibly in a multi-step forming process, the component is formed until it is almost completely finished. This formed component is then likewise heated to a temperature greater than the austenitization temperature and if need be, kept at this temperature for a desired, necessary period of time.

Then this heated component is transferred and inserted into a forming die that already has the dimensions of the component or the final dimensions of the component, if need be taking into account the thermal expansion of the preformed component. After the closing of the in particular cooled die, the preformed component is consequently cooled in this die at a speed that is greater than the critical hardening speed and is thus hardened.

In this connection, the direct method is somewhat simpler to implement, but only permits shapes that can actually be produced by means of a one-step forming process, i.e. relatively simple profile shapes.

The indirect process is somewhat more complex, but is also able to produce more complex shapes.

In addition to the need for press-hardened components, a need has also arisen to produce such components not out of uncoated sheet steel, but rather to provide such components with a corrosion protection layer.

In the automotive field, the corrosion protection layer can be composed either of rather infrequently used aluminum or aluminum alloys or of significantly more frequently used zinc-based coatings. In this connection, zinc has the advantage that it provides not just a barrier protection layer like aluminum does, but also a cathodic corrosion protection. In addition, zinc-coated press-hardened components fit better into the overall corrosion protection concept of vehicle bodies since in the construction technique that is currently popular, they are generally galvanized as a whole. In this respect, it is possible to reduce or eliminate contact corrosion.

But both methods could involve disadvantages that have also been discussed in the prior art. In the direct method, i.e. the hot forming of press-hardened steels with zinc coatings, microcracks (10 μm to 100 μm) or even macrocracks occur in the material; the microcracks occur in the coating and the macrocracks even extend through the entire cross-section of the sheet. Components of this kind with macrocracks are unsuitable for further use.

In the indirect process, i.e. cold forming with a subsequent hardening and remaining forming, microcracks in the coating can also occur, which are also undesirable, but far less pronounced.

Thus far—except for one component produced in Asia—zinc-coated steels have not been used in the direct method, i.e. hot forming. With this method, preference is given to using steels with an aluminum/silicon coating.

An overview is given in the publication "Corrosion resistance of different metallic coatings on press hardened steels for automotive", Arcelor Mittal Maiziere Automotive Product Research Center F-57283 Maiziere-Les-Mez. This publication states that for the hot forming process, there is an aluminized boron/manganese steel that is sold commercially under the name Usibor 1500P. In addition, steels that are pre-coated with zinc for purposes of cathodic corrosion protection are sold for the hot forming method, namely galvanized Usibor GI, which has a zinc coating containing small percentages of aluminum, and a so-called galvannealed, coated Usibor GA, which has a zinc coating containing 10% iron.

It is also noted that the zinc/iron phase diagram shows that above 782° C., there is a larger region in which liquid zinc-iron phases occur as long as the iron content is low, in particular less than 60%. But this is also the temperature range in which the austenitized steel is hot formed. It is also noted that if the forming occurs at a temperature greater than 782° C., then there is a high risk of stress corrosion due to liquid zinc, which presumably penetrates into the grain boundaries of the base steel, resulting in macrocracks in the base steel. Furthermore, at iron contents of less than 30% in the coating, the maximum temperature for the forming of a safe product without macrocracks is less than 782° C. This is the reason why direct forming methods are not used with these steels, but instead the indirect forming method is used. This is intended to bypass the above-mentioned problem.

Another possibility for bypassing this problem should lie in using galvannealed, coated steel, which is because the iron content of 10% that was already present at the beginning and the absence of a $Fe_2Al_5$ bather layer lead to a more homogeneous formation of the coating out of predominantly iron-rich phases. This results in a reduction or elimination of zinc-rich, liquid phases.

"'STUDY OF CRACKS PROPAGATION INSIDE THE STEEL ON PRESS HARDENED STEEL ZINC BASED COATINGS', Pascal Drillet, Raisa Grigorieva, Grégory Leuillier, Thomas Vietoris, 8th International Conference on Zinc and Zinc Alloy Coated Steel Sheet, GALVATECH 2011—Conference Proceedings, Genoa (Italy), 2011" indicates that galvanized sheets cannot be processed in the direct method.

EP 1 439 240 B1 has disclosed a method for hot forming a coated steel product; the steel material has a zinc or zinc alloy coating on the surface of the steel material and the steel base material with the coating is heated to a temperature of 700° C. to 1000° C. and hot formed; before the steel base material with the zinc or zinc alloy coating is heated, the coating has an oxide layer that is chiefly composed of zinc oxide in order to prevent the zinc from vaporizing during the heating. A special process sequence is provided for this purpose.

EP 1 642 991 B1 has disclosed a method for hot forming a steel in which a component composed of a boron/manganese steel is heated to a temperature at the $Ac_3$ point or higher, is kept at this temperature, and then the heated steel sheet is formed into the finished component; the formed component is quenched through cooling from the forming temperature during the forming or after the forming in such a way that the cooling rate at the MS point at least corresponds to the critical cooling rate and the average cooling rate of the formed component from the MS point to 200° C. lies in the range from 25° C./s to 150° C./s.

The applicant's patent EP 1 651 789 B1 has disclosed a method for manufacturing hardened components out of sheet steel; according to this method, formed parts composed of a sheet steel that is provided with a cathodic corrosion-protection layer are cold formed and undergo a heat treatment for purposes of austenitization; before, during, or after the cold forming of the formed part, a final trimming of the formed part and required punching procedures or the production of a hole pattern are carried out and the cold forming as well as the trimming and punching and arrangement of the hole pattern on the component are carried out 0.5% to 2% smaller than the dimensions that the final hardened component should have; the formed part, which has been cold formed for the heat treatment, is then heated in contact with atmospheric oxygen in at least some regions to a temperature that permits an austenitization of the steel material and the heated component is then transferred to a die and in this die, a so-called form hardening is carried out in which the contacting and pressing (holding) of the component by the form hardening dies cause the component to be cooled and thus hardened and the cathodic corrosion protection coating is composed of a mixture of essentially zinc and additionally, one or more oxygen-affine elements. As a result, on the surface of the corrosion protection coating, an oxide skin composed of the oxygen-affine elements forms during the heating, which protects the cathodic corrosion protection layer, in particular the zinc layer. In addition, in the method, the scale reduction of the component with regard to its final geometry takes into account the thermal expansion of the component so that neither a calibration nor a forming are required during the form hardening.

The applicant's patent WO 2010/109012 A1 has disclosed a method for manufacturing partially hardened steel components in which a blank composed of a hardenable steel sheet is subjected to a temperature increase that is sufficient for a quench hardening and after a desired temperature is reached and if need be, after a desired holding time, the blank is transferred to a forming die in which the blank is formed into a component and simultaneously quench hardened or the blank is cold formed and the component resulting from the cold forming is then subjected to a temperature increase, with the temperature increase being carried out so that a component temperature that is required for a quench hardening is reached and the component is then transferred to a die in which the heated component is cooled and thus quench hardened; during the heating of the blank or component for the purpose of increasing the temperature to a temperature required for the hardening, in the regions that should have a lower hardness and/or a higher ductility, absorption masses are placed or are spaced apart from these regions by a narrow gap; the absorption masses, with regard to their expansion and thickness, their thermal conductivity, and their thermal capacity and/or with regard to their emissivity, are especially dimensioned so that the thermal energy acting on the component in the region of the component that remains ductile flows through the component into the absorption mass so that these regions remain cooler and in particular, the temperature required for hardening is not reached or is only partially reached so that these regions cannot harden or can harden only partially.

DE 10 2005 003 551 A1 has disclosed a method for hot forming and hardening a steel sheet in which a steel sheet is heated to a temperature above the $Ac_3$ point, then undergoes a cooling to a temperature in the range from 400° C. to 600° C., and is only formed after reaching this temperature range. This reference, however, does not mention the crack problem or a coating and also does not describe a martensite formation. The object of the invention therein is the formation of intermediary structures, so-called bainite.

The object of the invention is to create a method for producing sheet steel components, which are in particular provided with a corrosion protection layer, with regions of different hardness and/or ductility while avoiding local stresses in the component, as well as distortion and cracks of the kind that can otherwise be caused by "liquid metal assisted cracking."

SUMMARY OF THE INVENTION

With regard to the mechanical properties, the object according to the invention can be implemented using both the so-called indirect process and using the so-called direct process. In order to achieve regions with different strengths in the quench hardening, in the indirect method, the blanks are formed into the finished component before the heating, possibly reduced in all three spatial axes by an expected thermal expansion. Then the component that has been heated in this way is heated in a furnace; in order to achieve regions with different temperatures, absorption masses or insulating elements or the like are provided in regions of the component that should be either not heated or heated less. By means of this, a temperature is reached in these regions that is lower than $Ac_3$ or possibly even lower than $Ac_1$ and in this respect, a quench hardening due to the transformation of austenite into martensite is limited or prevented. In the remaining regions, a complete austenitization is sought, which results in a martensitic hardness in the quench hardening.

In the direct method, the blank is heated without being formed and the regions of the blank that should not be hardened or should only be hardened a little are likewise brought into contact with absorption masses whose thermal conductivity and thermal capacity reduce a heating of the sheet or else corresponding insulation elements are likewise provided. Then this blank is formed.

According to the invention, however, in both cases, the temperature of the blank is homogenized before the hardening (indirect method) or before the hardening and forming (direct method). This means that before insertion into the forming die, the heated blank with the regions at different temperatures undergoes an intermediate cooling step in which the hotter regions are actively cooled to the temperature or temperature range of the cooler regions. An explanation as to how this happens will be given later.

In order to prevent an uncontrolled hardening during the cooling according to the invention, so-called transformation-delayed steels are used. This means that the transformation into martensite occurs later so that after homogenization of the temperature and insertion into the hardening die or hardening/forming die, despite being of a uniform temperature, the components have regions that are hardened by the subsequent rapid cooling with a cooling speed greater than the critical hardening speed while the other regions that have not been brought to the austenitization temperature are softer.

In this connection, it is advantageous that the homogenization of the temperature also results in a uniform formability, thus avoiding local stresses due to different temperatures or different thermomechanical properties and in particular, avoiding thinned regions in the boundary regions between cold regions and hot regions.

Another advantage that is achieved with the direct method is the avoidance of so-called "liquid metal embrittlement."

The above-described effect of crack formation due to liquid zinc, which penetrates the steel in the region of the grain boundaries, is also known as so-called "liquid metal embrittlement."

According to the discovery on which the invention is based, as little molten zinc as possible must come into contact with austenite during the forming phase, i.e. the introduction of stress. According to the invention, therefore, the forming must be carried out below the peritectic temperature of the iron/zinc system (melt, ferrite, gamma phase). In order to still be able to ensure a quench hardening in this case, the composition of the steel alloy as part of the conventional composition of a manganese/boron steel (22 MnB5) is adjusted so that a quench hardening is carried out by means of a delayed transformation of the austenite into martensite and thus austenite is present even at the lower temperature below 780° C. or lower so that at the moment in which mechanical stress is introduced into the steel, which in connection with austenite and molten zinc would lead to "liquid metal embrittlement," no liquid zinc phases or very little of them are present. Therefore, by means of a boron/manganese steel that is adjusted in accordance with the alloy elements, it succeeds in achieving a sufficient quench hardening without provoking an excessive or damaging crack formation.

It has also turned out that in addition to adjusting the steel composition, the active intermediate cooling before the forming is also required for a crack-free forming. The intermediate cooling can be carried out, for example, in one or more steps.

During the transfer times between the furnace and the press, additional intervals can be planned in order for the sheets—which have differently heated regions in order, for example, to cause no hardening at all in colder regions—to be homogenized in their temperature; in particular, a waiting period is provided until the regions heated to a temperature greater than the austenitization temperature have cooled to a temperature equal to the temperature of the less-heated regions. This equalization of the temperature profile can also take place by means of an active cooling of the hotter regions, in particular by means of a blowing or the like of these regions; if need be, the cold or cooler regions are covered, shielded, or insulated during the cooling of the heated regions.

Particularly in the special case of sheets of different temperatures, the blowing of the air jets can be controlled by means of pyrometers, which are provided, for example, outside the press and the furnace in a separate piece of equipment in the same way as the corresponding jets.

The cooling possibilities in this case are not limited to air jets; it is also possible to use cooled tables on which the blanks are correspondingly positioned and which include cooled and non-cooled regions so that the regions of the blanks to be cooled come to lie on cooled regions of the table and are brought into thermally conductive contact, for example, by means of pressure or suction.

It is also conceivable to use a cooling press in which the flat blanks conceivably permit the press geometry to be simple and favorable; the regions of the die in which the blank is to be cooled are correspondingly liquid-cooled while the regions that are not to be cooled are shielded, for example relative to the cold metal of the press, by means of insulating layers that are inserted into the dies or these regions are heated slightly or their temperature is maintained, for example by means of induction.

In blanks with regions of different temperatures, a uniform forming temperature is achieved before the forming, which ensures an improved forming behavior in the forming press.

In both methods, it is advantageous that due to the lower temperature for the hardening, less energy has to be dissipated and the cycle times are therefore reduced.

BRIEF DESCRIPTION OF THE DRAWINGS

The invention will be explained below in conjunction with the drawings.

DETAILED DESCRIPTION OF THE PREFERRED EMBODIMENTS

According to the invention, a conventional boron/manganese steel for use as a press-hardened steel material is adjusted with regard to the transformation of the austenite into other phases so that the transformation moves into deeper regions and martensite can be produced.

Steels of the following alloy composition are therefore suitable for the invention (all data in mass %):

| C [%] | Si [%] | Mn [%] | P [%] | S [%] | Al [%] | Cr [%] | Ti [%] | B [%] | N [%] |
|---|---|---|---|---|---|---|---|---|---|
| 0.22 | 0.19 | 1.22 | 0.0066 | 0.001 | 0.053 | 0.26 | 0.031 | 0.0025 | 0.0042 |

the rest being made up of iron and inevitable smelting-related impurities

In steels of this kind, in particular the alloy elements boron, manganese, carbon, and optionally chromium and molybdenum are used as transformation inhibitors.

Steels of the following general alloy composition are also suitable for the invention (all data in mass %):

| | |
|---|---|
| Carbon (C) | 0.08-0.6 |
| Manganese (Mn) | 0.8-3.0 |
| Aluminum (Al) | 0.01-0.07 |
| Silicon (Si) | 0.01-0.5 |
| Chromium (Cr) | 0.02-0.6 |
| Titanium (Ti) | 0.01-0.08 |
| Nitrogen (N) | <0.02 |
| Boron (B) | 0.002-0.02 |
| Phosphorus (P) | <0.01 |
| Sulfur(S) | <0.01 |
| Molybdenum (Mo) | <1 |

the rest being made up of iron and inevitable smelting-related impurities

Steels of the following composition have turned out to be particularly suitable (all data in mass %):

| | |
|---|---|
| Carbon (C) | 0.08-0.30 |
| Manganese (Mn) | 1.00-3.00 |
| Aluminum (Al) | 0.03-0.06 |
| Silicon (Si) | 0.01-0.20 |
| Chromium (Cr) | 0.02-0.3 |
| Titanium (Ti) | 0.03-0.04 |
| Nitrogen (N) | <0.007 |
| Boron (B) | 0.002-0.006 |
| Phosphorus (P) | <0.01 |
| Sulfur (S) | <0.01 |
| Molybdenum (Mo) | <1 |

the rest being made up of iron and inevitable smelting-related impurities

The alloy elements functioning as transformation inhibitors are adjusted to reliably achieve a quench hardening, i.e. a rapid cooling with a cooling speed that is greater than the critical hardening speed even below 780° C. This means that in this case, work is carried out below the peritectic point of the zinc/iron system, i.e. mechanical stress is exerted only below the peritectic point. This also means that at the moment in which mechanical stress is exerted, liquid zinc phases that could come into contact with the austenite are no longer present.

In addition, after the heating of the blank, a holding phase in the temperature range of the peritectic point can be provided according to the invention so that the solidification of the zinc coating is promoted and advanced before the subsequent forming procedure is carried out.

Figure 1:
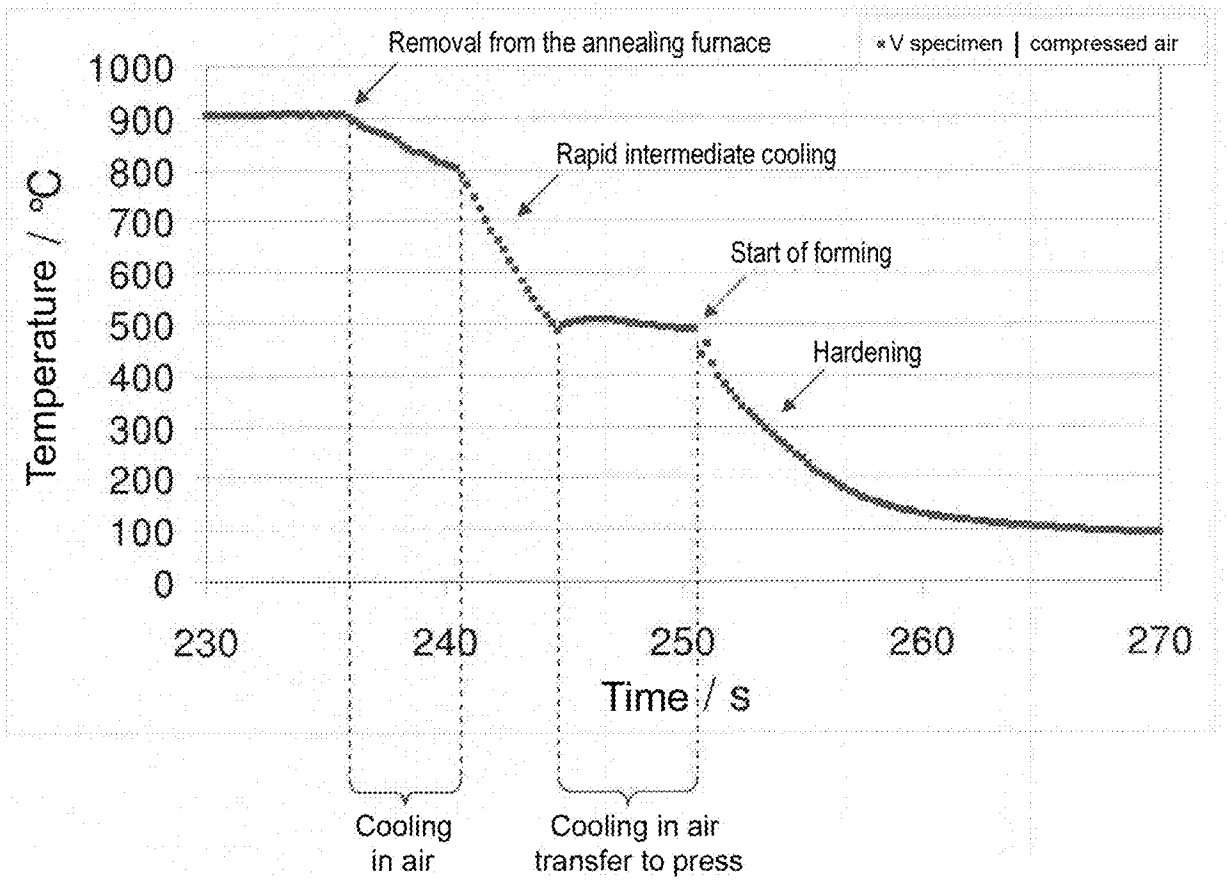
FIG. 1: shows the time/temperature curve in the cooling between the furnace and the forming procedure.
Figure 2:
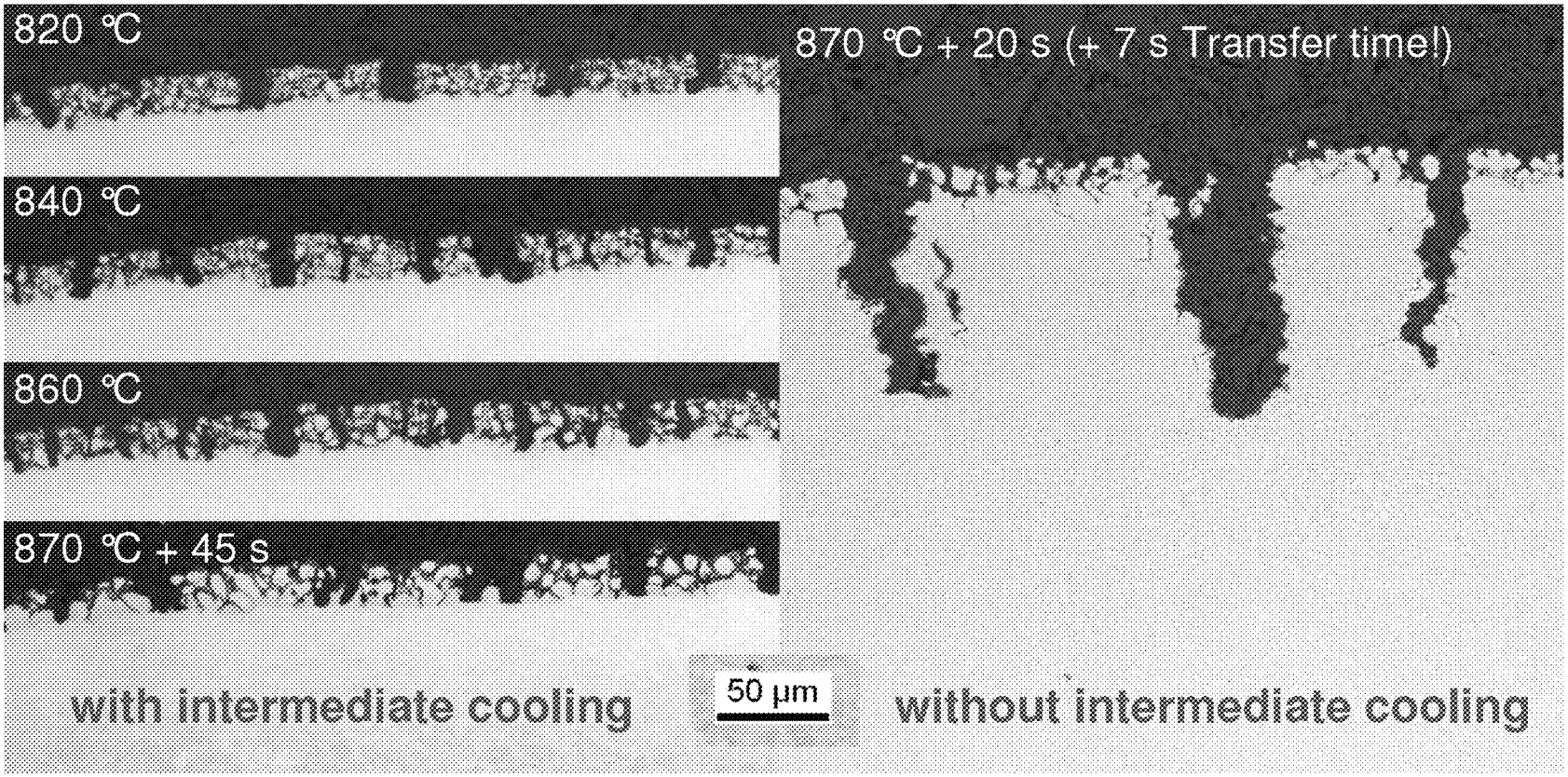
FIG. 2: shows powerfully magnified images of the specimens with the different temperatures.

FIG. 1 shows a favorable temperature curve for an austenitized steel sheet; it is clear that after the heating to a temperature greater than the austenitization temperature and the corresponding passage of a corresponding amount of time in a cooling device, a certain amount of cooling already occurs. This is followed by a rapid intermediate cooling step. The intermediate cooling step is advantageously carried out with cooling speeds of at least 15 K/s, preferably at least 30 K/s, even more preferably at least 50 K/s. Then the blank is transferred to the press and the forming and hardening are carried out.

Figure 4:
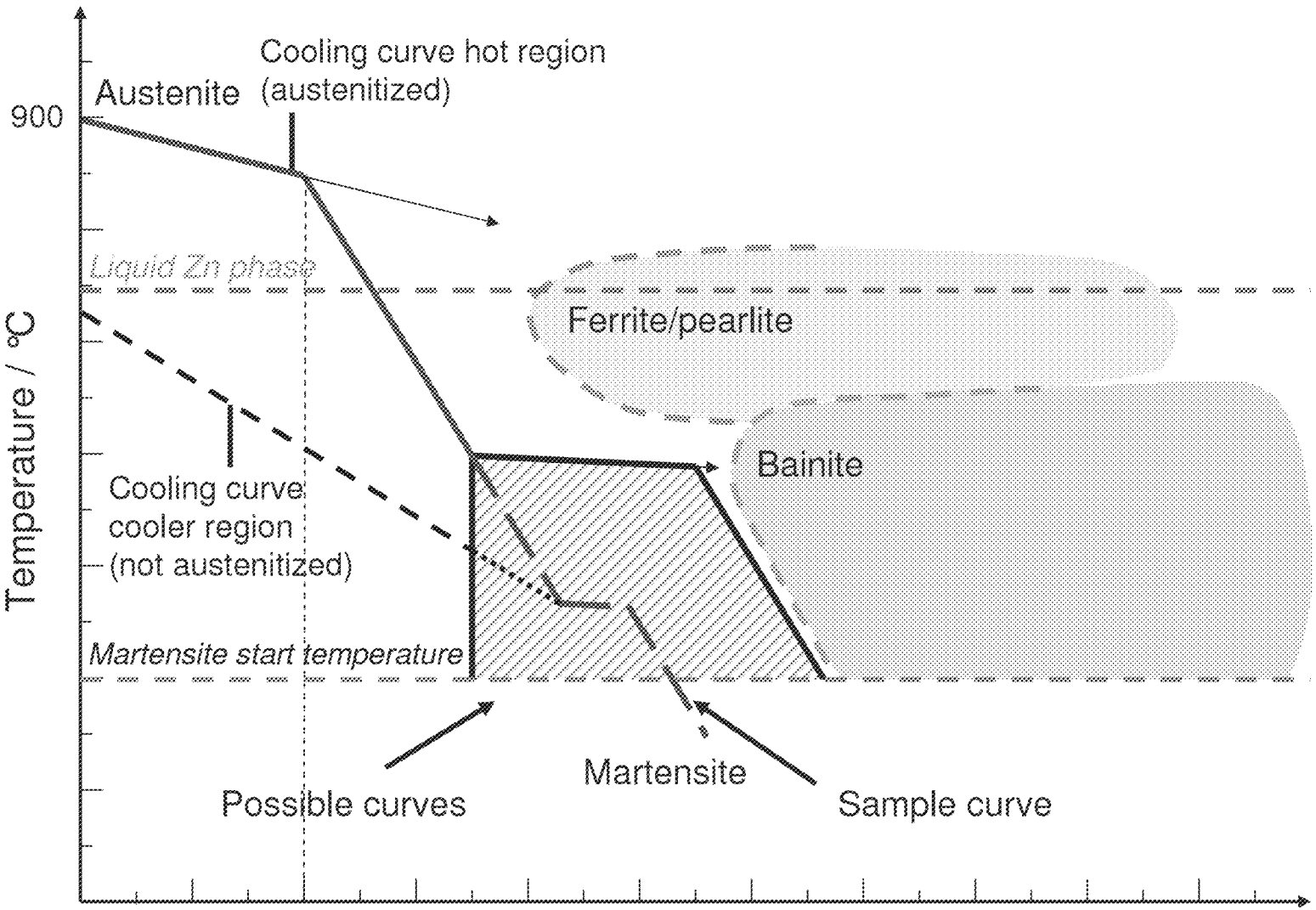
FIG. 4: shows the zinc/iron phase diagram, with corresponding cooling curves for sheets with differently heated regions.
Figure 5:
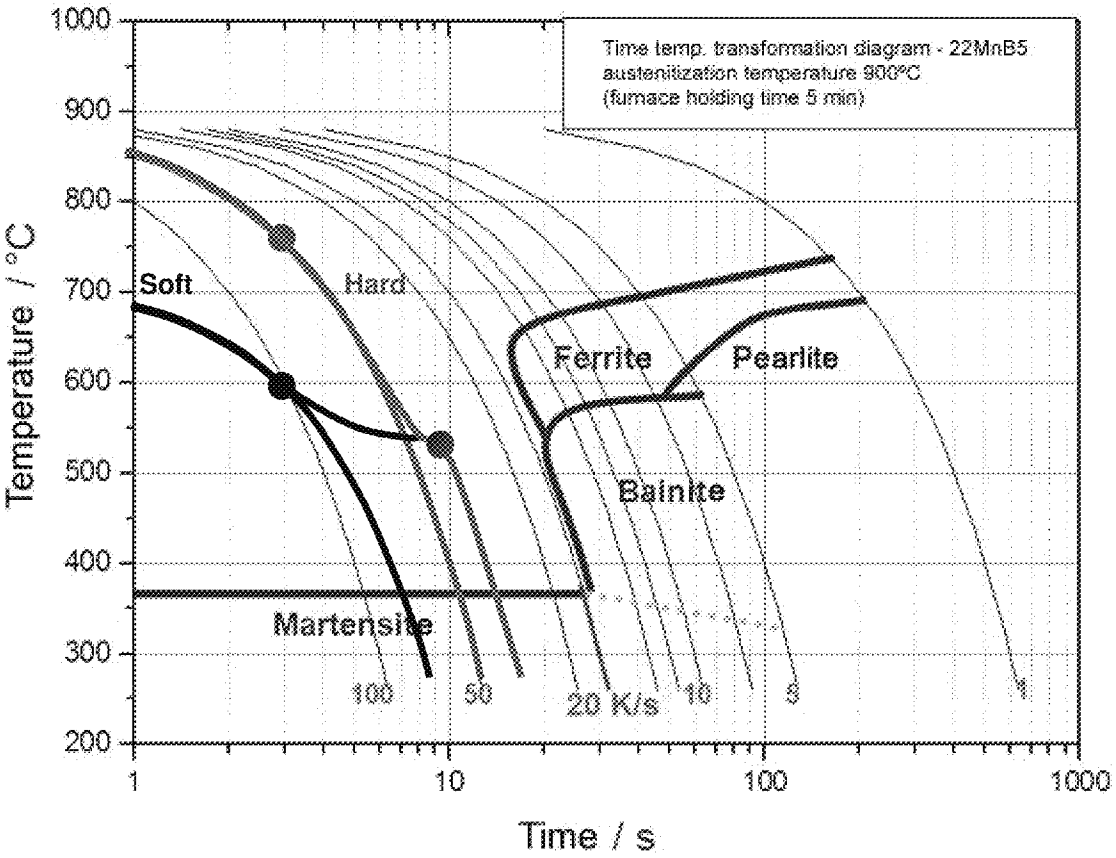
FIG. 5: is a time temperature transformation diagram.
Figure 6:
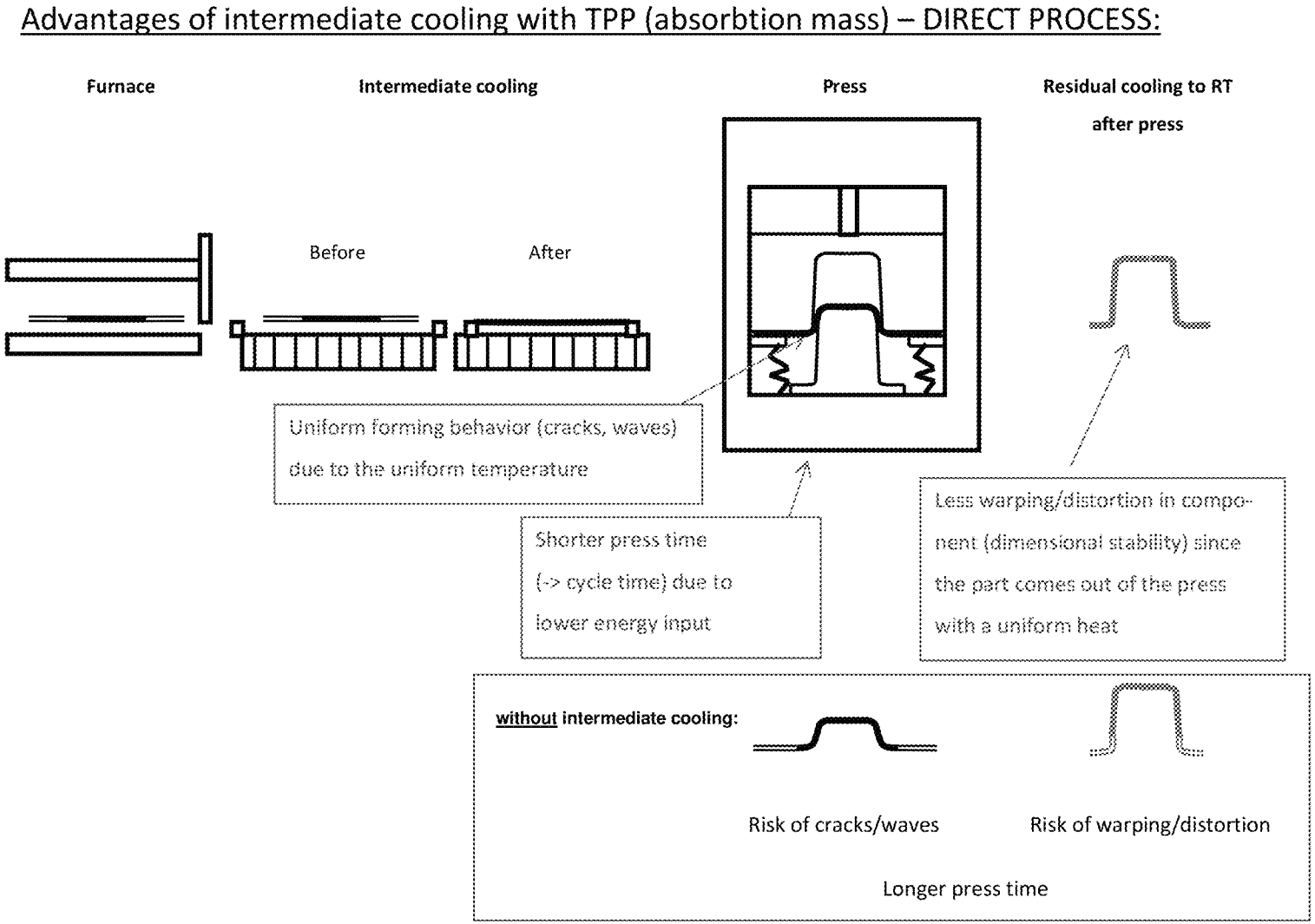
FIG. 6: schematically depicts the sequence of the method according to the invention in the direct process.
Figure 7:
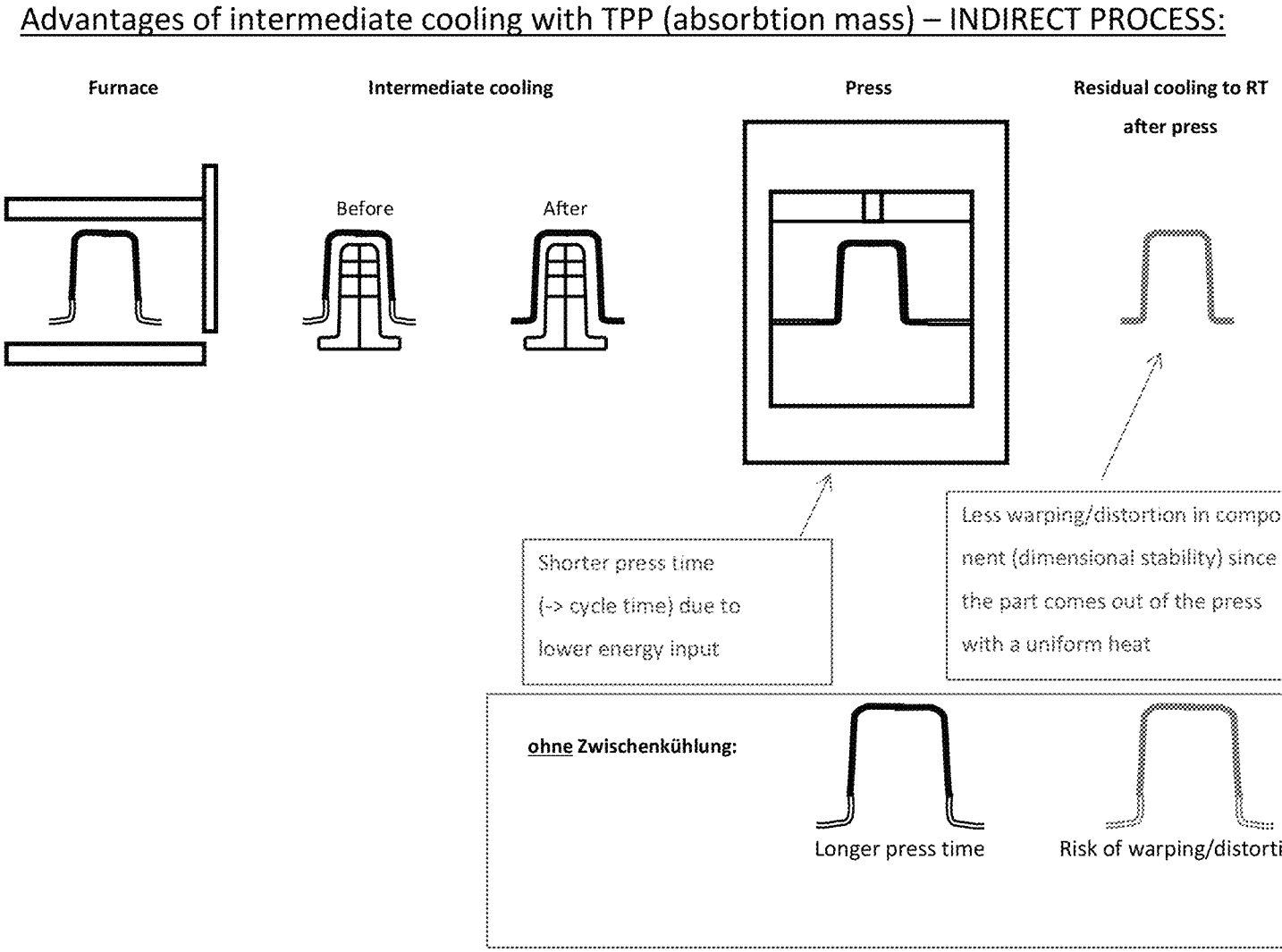
FIG. 7: schematically depicts the sequence of the method according to the invention in the indirect process.
Figure 8:
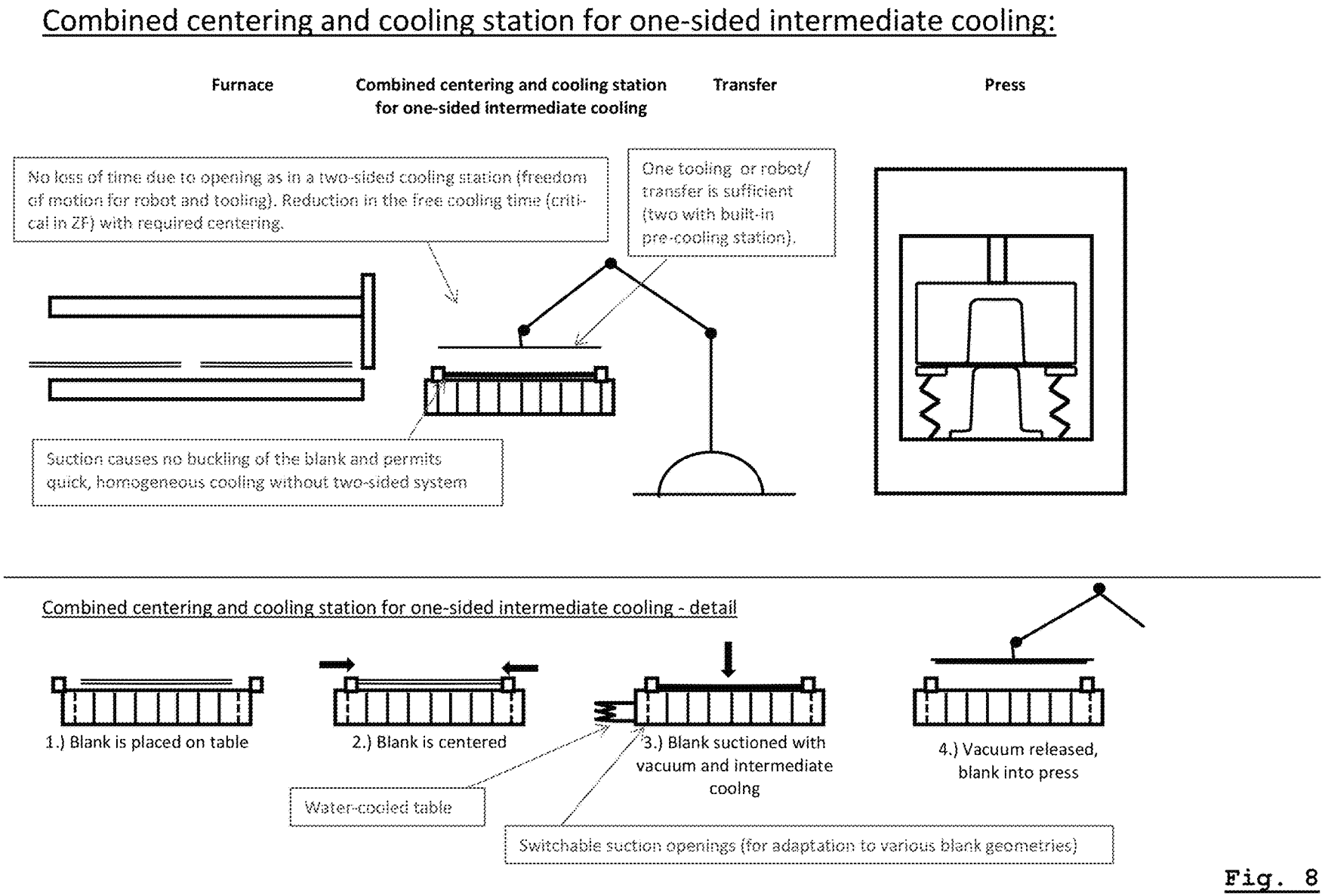
FIG. 8: schematically depicts the sequence with a combined centering and cooling station for one-sided intermediate cooling.

The iron/carbon diagram in FIG. 4 shows how, for example, a blank with hot regions of different temperatures is correspondingly treated. It shows that the hot regions to be hardened have been heated to a high starting temperature of between 800° C. and 900° C. while the soft regions have been heated to a temperature below 700° C. and in particular are not available for a hardening. A temperature equalization is visible at a temperature of approximately 550° C. or somewhat lower; after the hotter regions have been adjusted to this temperature of the other regions, the rapid cooling takes place at 20 K/s.

For the purposes of the invention, it is sufficient if the temperature equalization here is carried out so that there are still differences in the temperatures of the (formerly) hot regions and the (formerly) cooler regions that do not exceed 75° C., in particular 50° C. (in both directions).

Figure 3:
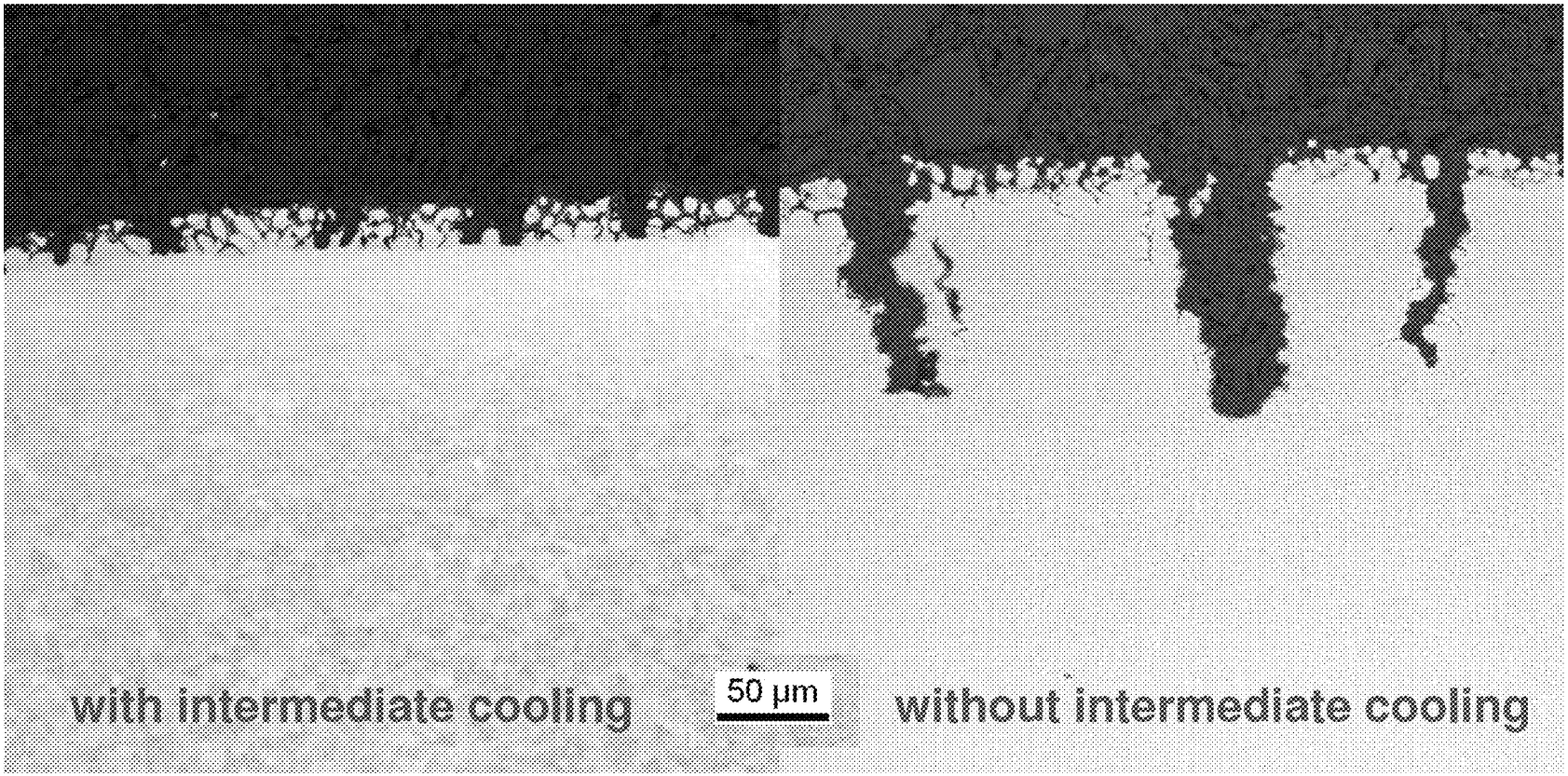
FIG. 3: shows ground cross-sections of the specimens according to FIG. 2.

FIG. 3 shows the difference in the crack formation. Without intermediate cooling, cracks form that extend into the steel material; with the intermediate cooling, only surface cracks in the coating occur; these are not critical, however.

With the invention, it is therefore possible to reliably achieve an inexpensive hot forming method for steel sheets coated with zinc or zinc alloys with regions of different hardness and/or ductility, which on the one hand, induces a quench hardening and on the other hand, reduces or eliminates microcrack and macrocrack formation that leads to component damage.

The invention claimed is:

1. A method for producing a hardened, steel component with regions of different hardness or ductility, or both hardness and ductility, comprising:

providing steel material having the following composition, all data in mass %:

| | |
|---|---|
| Carbon (C) | 0.08-0.6 |
| Manganese (Mn) | 0.8-3.0 |
| Aluminum (Al) | 0.01-0.07 |
| Silicon (Si) | 0.01-0.5 |
| Chromium (Cr) | 0.02-0.6 |
| Titanium (Ti) | 0.01-0.08 |
| Nitrogen (N) | <0.02 |
| Boron (B) | 0.002-0.02 |
| Phosphorus (P) | <0.01 |
| Sulfur(S) | <0.01 |
| Molybdenum (Mo) | <1 |

a remainder being made up of iron and inevitable smelting-related impurities, wherein the steel material comprises the elements boron, manganese, carbon, chromium, and optionally molybdenum as transformation inhibitors, and the composition of the steel material has transformation-delaying properties so that a quench hardening through transformation of austenite into martensite takes place at a forming temperature that lies in a range from 450° C. to 700° C., stamping out a blank of the steel material;

heating the stamped-out blank in at least one first region to a temperature $\geq Ac_3$ while keeping the stamped-out blank in at least one second region at a temperature below $Ac_1$ and, optionally, keeping the at least one first region at the temperature $\geq Ac_3$ for a predetermined time in order to induce formation of austenite in the at least one first region;

homogenizing a temperature of the blank by waiting until the at least one first region heated to a temperature $\geq Ac_3$ is equalized in temperature within 50K relative to the at least one second region kept at a temperature below $Ac_1$;

after homogenizing the temperature of the blank, actively cooling the blank at a cooling speed >15 K/s, and then transferring the blank that has been heated, homogenized to an essentially uniform temperature within a range of 50K, and subsequently actively cooled, to a forming die, forming the blank in the forming die, and cooling the blank in the forming die at a speed that is greater than a critical hardening speed and thus hardening the formed blank.

2. The method according to claim 1, comprising using a steel material of the following composition, all data in mass %:

| | |
|---|---|
| Carbon (C) | 0.08-0.30 |
| Manganese (Mn) | 1.00-3.00 |
| Aluminum (Al) | 0.03-0.06 |
| Silicon (Si) | 0.01-0.20 |
| Chromium (Cr) | 0.02-0.3 |
| Titanium (Ti) | 0.03-0.04 |
| Nitrogen (N) | <0.007 |
| Boron (B) | 0.002-0.006 |
| Phosphorus (P) | <0.01 |

-continued

| | |
|---|---|
| Sulfur (S) | <0.01 |
| Molybdenum (Mo) | <1 |

the rest being made up of iron and inevitable smelting-related impurities.

3. The method according to claim 1, comprising carrying out the active cooling so that the cooling rate is >30 K/s.

4. The method according to claim 3, comprising carrying out the active cooling so that the cooling takes place at more than 50 K/s.

5. The method according to claim 1, comprising producing the active cooling by blowing with air or gas, spraying with water or other cooling liquids, immersion in water or other cooling liquids, or by placing cooler solid components against the blank.

6. The method according to claim 5, comprising monitoring the temperature of the blank in the forming die using pyrometers, and correspondingly controlling the cooling of the blank in the forming die.

7. The method according to claim 1, comprising using a steel material that is coated with zinc or a zinc alloy as the steel material.

8. The method according to cm 7, comprising heating the at least one first region of the blank in a furnace to a temperature $< Ac_3$ and keeping the at least one first region of the blank at this temperature for a predetermined time and then cooling the blank and homogenizing the temperature of the blank to between 500° C. and 600° C. in order to achieve a solidification of a zinc coating layer and then transferring the blank into the forming die and forming the component therein.

* * * * *